US006106084A

United States Patent [19]

Thögersen et al.

[11] Patent Number: 6,106,084

[45] Date of Patent: Aug. 22, 2000

[54] CATERING CART WITH VERTICALLY MOVEABLE INSERT

[75] Inventors: Lars Höjgaard Thögersen, Köpenhamn; Nils Toft, Naerum, both of Denmark

[73] Assignee: Scandinavian Airline System, Stockholm, Sweden

[21] Appl. No.: 08/973,856

[22] PCT Filed: Apr. 24, 1997

[86] PCT No.: PCT/SE97/00689

§ 371 Date: Mar. 2, 1998

§ 102(e) Date: Mar. 2, 1998

[87] PCT Pub. No.: WO97/39654

PCT Pub. Date: Oct. 30, 1997

[30] Foreign Application Priority Data

Apr. 25, 1996 [SE] Sweden ..... 9601580

[51] Int. Cl.[7] ..... A47B 57/00

[52] U.S. Cl. ..... 312/306; 312/310

[58] Field of Search ..... 312/308, 299, 312/306, 292, 319.2, 319.1, 270.1, 310, 312

[56] References Cited

U.S. PATENT DOCUMENTS

| | | | |
|---|---|---|---|
| 2,910,335 | 10/1959 | Wales | 312/306 |
| 3,494,503 | 2/1970 | Kingsley | 312/306 |

FOREIGN PATENT DOCUMENTS

| | | | |
|---|---|---|---|
| 459402 | 9/1950 | Italy | 312/292 |
| 815918 | 7/1959 | United Kingdom | 312/306 |

*Primary Examiner*—Peter M. Cuomo
*Assistant Examiner*—Gerald A. Anderson
*Attorney, Agent, or Firm*—John Lezdey & Assoc

[57] ABSTRACT

A catering cart whose height is substantially greater than its width and its length, particularly a catering cart for use in confined spaces, such as the aisles of passenger aircraft and railway diners. The cart is provided with four wheels, at least two of which are castor wheels, and the cart is constructed to receive goods that can be stacked vertically in the cart. An insert whose height is substantially equal to half the internal height of the cart is mounted in the cart and can move vertically from a lower position in the bottom half of the cart to an upper position in the upper half of the cart, wherein goods can be inserted into or removed from the insert through an access opening provided in one side of the cart, when the insert is in its upper position.

4 Claims, 5 Drawing Sheets

CATERING CART WITH VERTICALLY MOVEABLE INSERT

BACKGROUND OF THE INVENTION

1. Field of the Invention

The present invention relates to a service cart or trolley and then particularly to a catering cart or trolley for use in confined spaces such as the aisles of passenger aircraft and railway diners. The cart is provided with four wheels, at least two of which are castor wheels, and the cart is constructed to receive goods that can be stacked vertically in the cart. An insert whose height is substantially equal to half the internal height of the cart is mounted in the cart and can move vertically.

2. Description of the Prior Art

The catering carts of the kind intended here can be attended to from two opposite directions and are normally designed to carry prepacked food trays placed from the bottom of the cart and upwards, although the carts may alternatively be designed for other purposes. The known catering carts, however, are encumbered with certain drawbacks. For instance, in order to utilize the carts to the best possible extent they are filled with trays from the bottom of the cart to the top thereof, when used to distribute prepacked food trays. This means that the serving personnel are forced to bend down to progressively greater extents as the cart is emptied and finally squat or go down on their knees in order to reach trays that are located at the bottom of the trolley. This applies both when distributing and when collecting the trays, and is an uncomfortable and tiresome task which is liable to result in bodily wear and tear.

SUMMARY OF THE INVENTION

The present invention is intended to facilitate the work of attendant personnel with this type of catering cart or trolley, which is achieved with a catering cart having the characteristic features set forth in the following Claims.

BRIEF DESCRIPTION OF THE PREFERRED DRAWINGS

The invention will now be described in more detail with reference to exemplifying embodiments thereof and also with reference to the accompanying drawings, in which FIGS. 1, 2 and 3 illustrate schematically an inventive catering cart in various handling stages;

DESCRIPTION OF THE PREFERRED EMBODIMENTS

Figure 2:
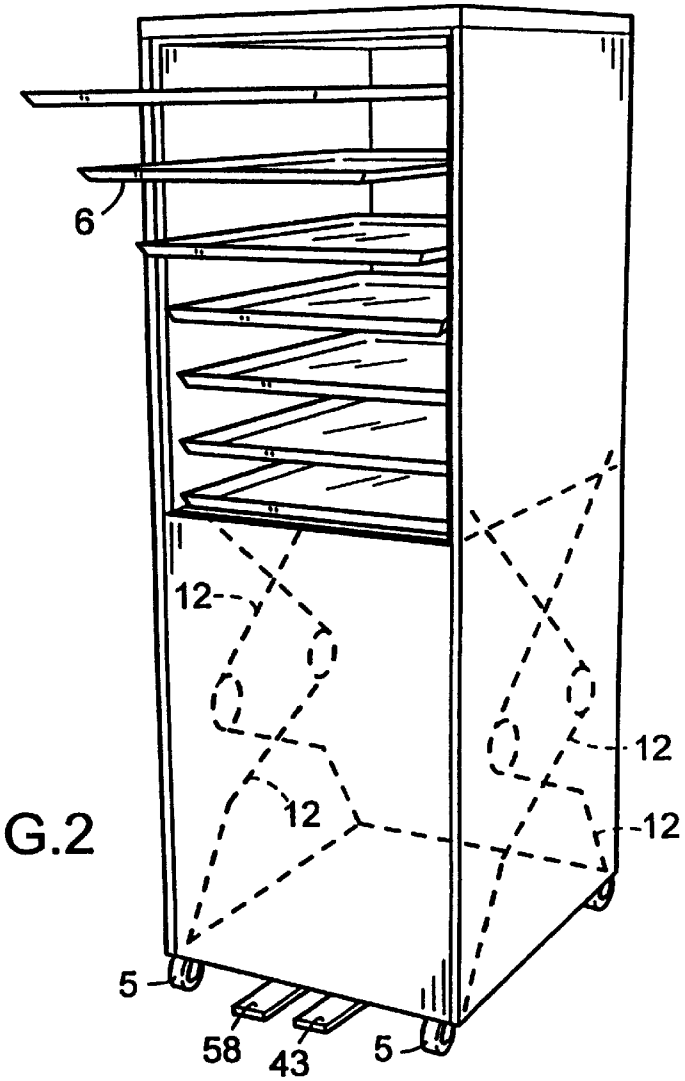
Figure 1:
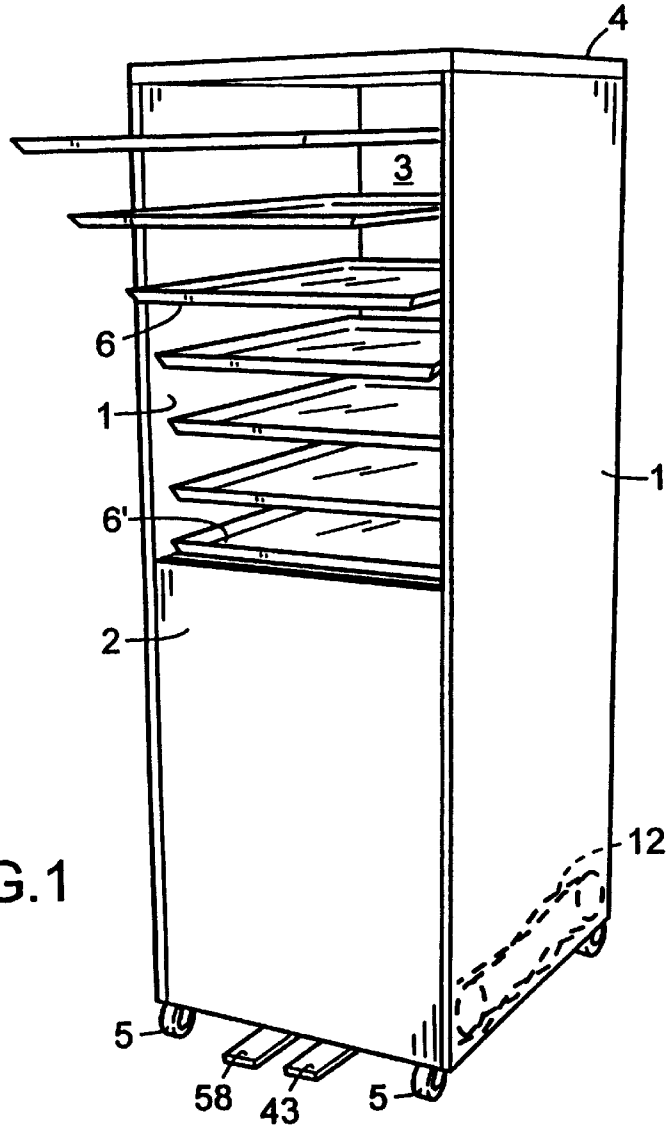
Figure 3:
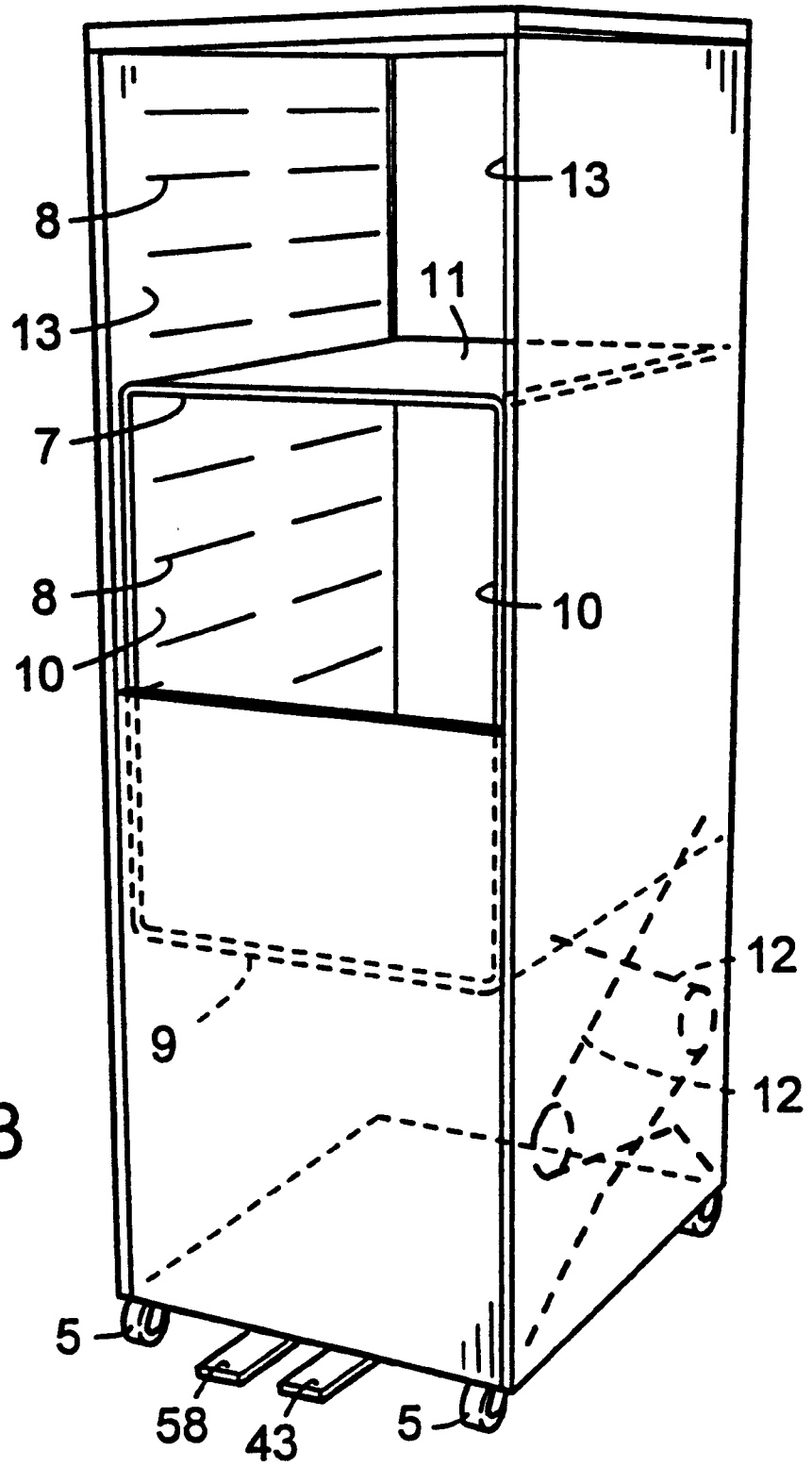

FIGS. 1–3 illustrate schematically an inventive catering cart or trolley which comprises two sides 1, a front 2, a back 3 and a top 4. The cart is movable on four wheels, of which the rear wheels 5 are castors. Access can be had to the interior of the cart through an opening in the upper half of the front side 2 of the cart, this opening being closable by means of a flap (not shown). The reference numeral 6 identifies trays intended for serving prepacked food in aircraft, for instance. As will be seen from FIG. 3, the cart includes a raisable and lowerable insert 7 which, in principle, takes-up the lower half of the cart interior and which is constructed to serve as the upper half of the catering cart. The trays 6 are supported on ledges mounted on two opposing inner side-wall surfaces 13. The insert 7 is, in principle, a frame structure that includes a bottom 9, two side walls 10 and a top 11. As will be seen from FIG. 3, tray carrying ledges 8 are fitted to the walls 10 of the insert. The insert 7 is supported on each side thereof by two wire springs that have a general "safety-pin" configuration (shown only on one side in FIG. 3). One end of respective springs 12 supports against the bottom part of the cart while the other end thereof supports the actual insert. Respective wire springs consist of two legs and a wire loop therebetween, as indicated in the drawings.

Access to the interior of the catering cart can be had through the open front 2 in the upper half of the cart, and the trays 6 can be inserted into and removed from the cart through this opening. Serving personnel are able to remove one tray at a time from the upper half of the cart while standing in a upright position, beginning from the top of the stack. When the lowermost tray has been removed, for instance the tray 6', the insert 7, which is locked suitably in its lower position, is raised to its upper position, shown in FIG. 2, in which the interior of the insert can now be reached through said opening. The serving personnel are now able to remove the remainder of the trays from the cart without needing to bend or squat. Trays are loaded into the cart in the reverse order, i.e. trays are first loaded into the insert 7 and the loaded insert then pressed down to its lower position against the action of the springs 12 (see FIG. 2) and locked in this position, whereafter the remaining trays 6 are loaded into the upper part of the cart.

Figure 6:
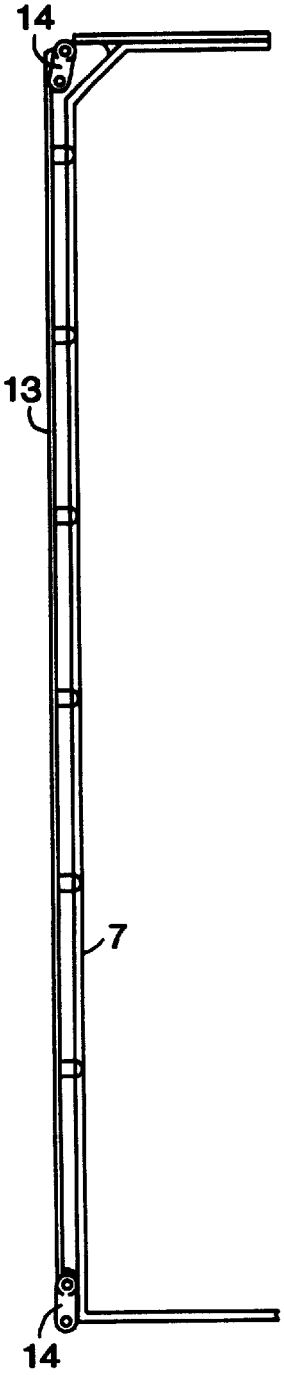
FIGS. 4, 5 and 6 are schematic illustrations of one part of an inventive cart.
Figure 5:
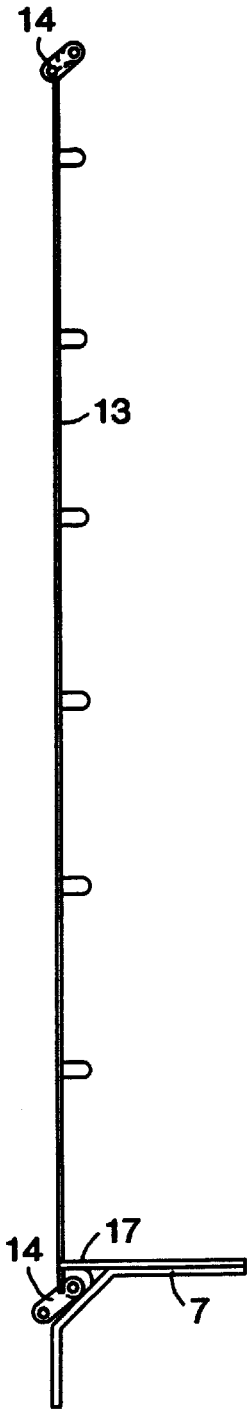
Figure 4:
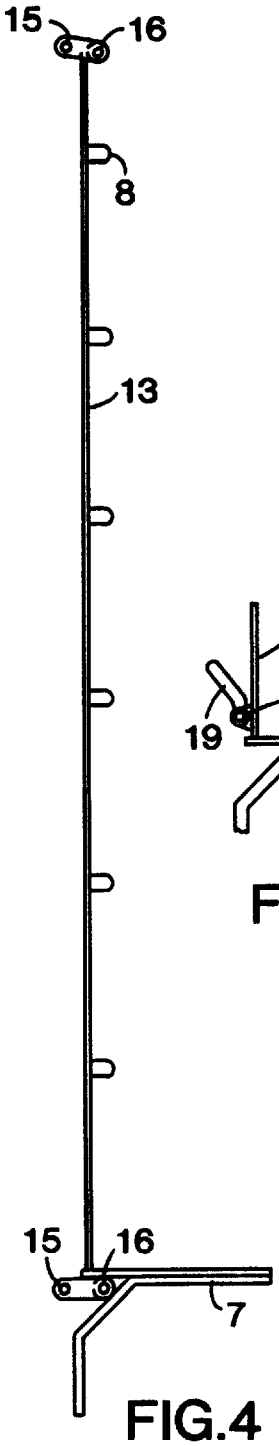
Figure 7:
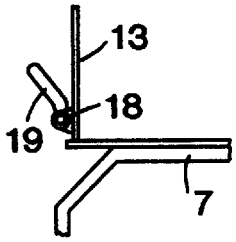
FIG. 7 illustrates another embodiment of this part of the cart.

The internal measurement between the walls 10 of the insert 7 is governed by the measurement of the trays received in the catering cart. The distance between the inner side walls 13 of the upper part of the cart, i.e. the side walls above the insert 7 in the lower position of said insert, is also governed by the size of the trays and, in respect of the position of the insert shown in FIG. 1, must be the same as the distance between the walls 10 of said insert. Thus, when the insert 7 is raised, the side walls 13 must move away from one another to provide room for the insert. This is shown schematically in FIGS. 4–6, in which respective side walls 13 (only one is shown) are shown to be suspended in the cart by means of links 14, suitably one in each corner of the side wall 13. Respective links 14 are mounted on the cart by means of a pivot bearing 15 and a pivot bearing 16 in the side wall 13. FIG. 4 shows the insert 7 in its lower position, with the walls 13 in a tray-carrying position. Provided on each side of the insert 7 is a flange 17 on which the bottom edge of the side wall 13 supports. FIG. 5 shows the insert in a slightly raised position with the wall 13 raised to a corresponding extent and swung around the links 14. As the insert 7 continues to move upwards, respective walls 13 will also be lifted while swinging outwards around the links 14. FIG. 7 shows the insert 7 fully raised in the upper part of the cart, with respective walls 13 swung fully outwards of the insert so as to provide room therefor.

FIG. 7 illustrates another solution for moving respective walls 13 to one side. The wall 13 is provided suitably at each corner with a pin 18 which runs in a knee-shaped groove 19, which has a straight part and a part which extends obliquely upwards and outwards from said straight part. Thus, when the wall 13 is lifted by the insert 7, the grooves 19 function to guide the wall 13 outwardly from the region of the insert.

Figure 8:
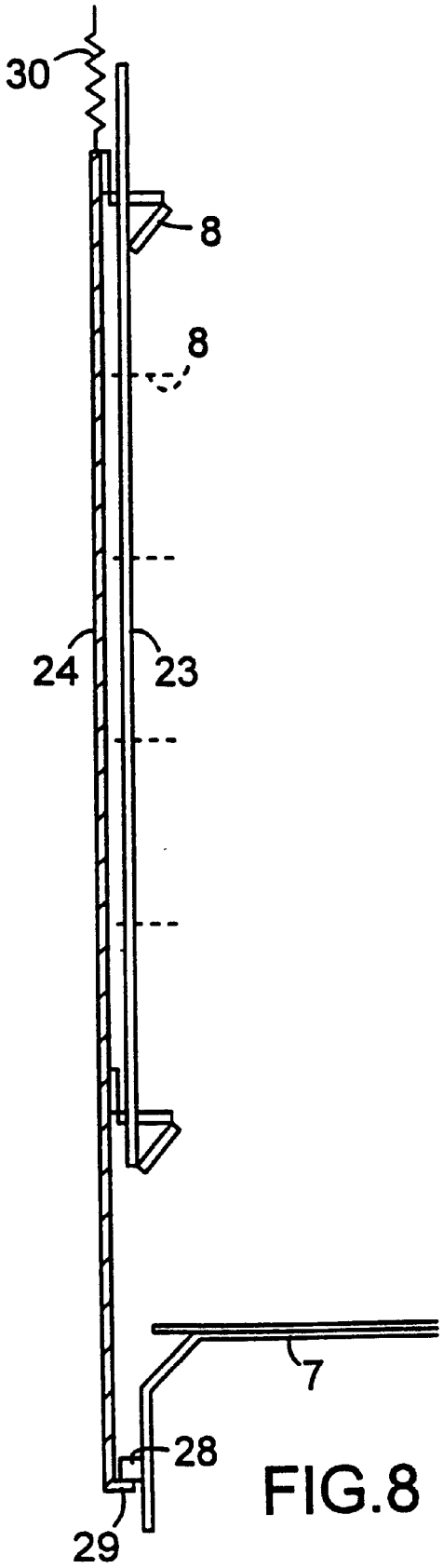
FIGS. 8 and 9 illustrate schematically a part of the inventive cart that has been further modified in relation to FIGS. 4–7.
Figure 9:
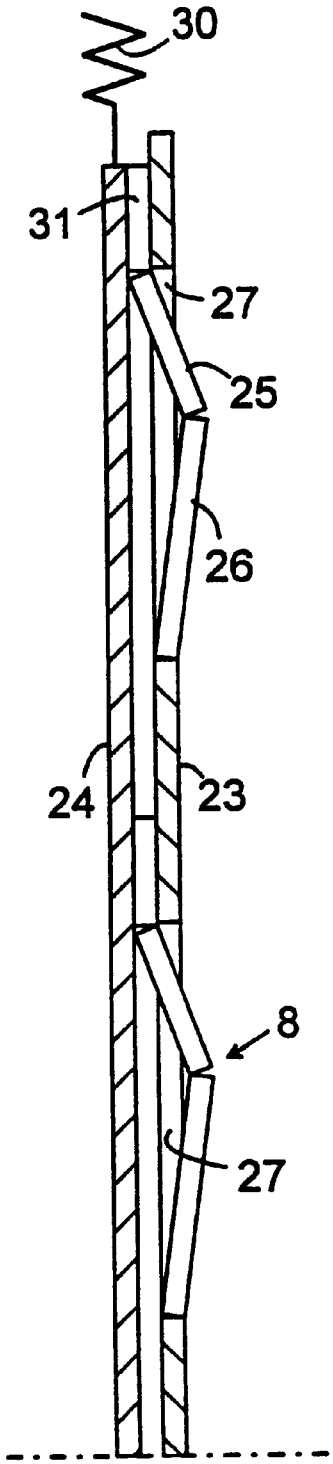
Figure 10:
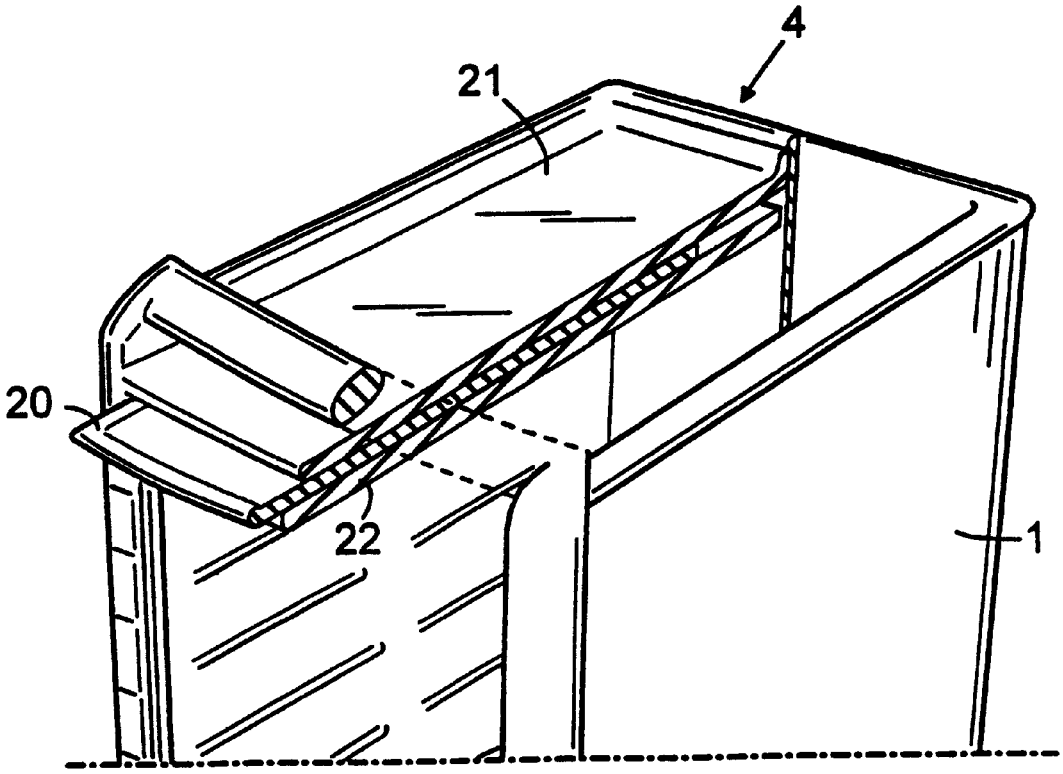
FIG. 10 illustrates schematically the construction of a closable flap or cover member.

FIGS. 8 and 9 illustrate another embodiment of the insides of the upper part of the catering cart. In this case, the two mutually opposing upper parts or walls 23 are fixed to the cart at a distance from one another that will permit the insert to move therebetween. Outwardly of the inner part 23 is a vertically movable part or wall 24 that includes a ledge 29 which grips beneath a shoulder 28 on the insert 7. In this embodiment, there is provided at the top of the vertically movable part or wall 24 a draw spring 30 which constantly strives to lift the outer wall 24. It will be understood that the casing of the catering cart is located outwardly of the parts 23 and 24 and surrounds the same. Each of the tray-carrying ledges 8 comprises two elongated, rigid strips 25, 26 which are mutually hinged by foil hinges. The lower strip 26 of respective ledges 8 is hinged to the inner part 23 by a foil hinge, whereas the upper strip 25 is hinged by a foil hinge to a further connecting strip 31 which, in turn, is firmly fixed, e.g. glued, to the outer part 24. The ledge comprising said two strips 25, 26 extends through an aperture 27 in the inner part 23.

FIG. 8 shows the insert 7 in its lowest position, therewith pulling the outer part downwards against the force of the spring 30, which causes the upper strips 25 of respective ledges 8 to be positioned horizontally, while the bottom strip 26 of said ledge forms an acute angle which acts as a support for the upper strip 25, this upper strip being intended to support the trays. When the insert 7 is lifted, the spring 30 draws the outer part 24 upwards, wherewith both strips 25 and 26 of the ledge 8 are drawn up to an essentially vertical position, as shown in FIG. 9. The ledge 8, i.e. the strips 25 and 26, are now located substantially in the aperture 27. The insert 7 can therewith pass freely between the inner parts or inner walls 23 to its upper position. Correspondingly, when the insert 7 is lowered, the shoulder 28 comes into contact with the ledge 29 therewith pulling down the outer part 24, whereby the ledges 8 return to the tray-receiving position shown in FIG. 8.

A handle may conveniently be provided at the top of the insert, and means may be provided for locking the insert in its top and bottom positions. This has not been shown in the drawings, since the provision of such means can be achieved in a simple manner of an unpatentable nature.

FIG. 8 is a partially sectioned view of the top part 4 of the catering cart, and shows the top part 4 of the cart provided with a flap 20 that can be moved horizontally therein. The rear edge of the flap 20 includes pins (not shown) which extend outwardly and transversely to the movement direction of the flap 20 and each of which runs in its respective horizontal groove in the side parts 1 of the cart. The flap 20 also moves between a laying-off surface 21 and a top surface 22 and can thus be drawn out from the position shown in FIG. 2 and then dropped down about its hinge pins, so as to cover the serving opening of the cart. The cart may be provided with suitable means for latching the flap in its open and closed positions.

What is claimed is:

1. A catering cart, having two upright side walls a back wall and a front wall, and a height that is substantially greater than a width and a length of said cart, said cart having four wheels, at least two of said wheels are castors, said cart having an interior space, upper portion, a lower portion, an opening in the upper portion of one of said walls for access into he interior space and means to receive vertically stackable good in said upper portion including two movable inner side walls, said cart includes a movable insert having a height that is essentially equal to half the height of the cart, wherein the insert can be moved vertically in the interior space from the lower portion of said cart to the upper portion of said cart, wherein goods can be inserted into or removed from said insert in said upper portion through said opening, said cart having a spring means connected to the movable insert to bias movement of the insert toward said upper portion, said insert being composed of two opposing walls which are mutually connected at a top and a bottom of the insert, and wherein said movable inner side walls in the upper portion of the cart are movable from positions in planes with the insert opposing side walls, blocking movement of the insert, to positions outside said planes to allow said insert to move into said upper portion of the cart.

2. A catering cart according to claim 1, further having pins having an axes and grooves, said pins being fixedly mounted at a top and a bottom of vertical edges of the respective said side walls, wherein pin axes extend generally horizontal and parallel with a plane of the respective side walls and said pins run in said grooves which extend upwardly and outwardly to enable said walls to move.

3. A catering cart, having two upright side walls, a back wall and a front wall, and a height that is substantially greater than a width and a length of said cart, said cart having four wheels, at least two of said wheels are castors, said cart having an interior space, a upper portion, a lower portion, an opening in the upper portion of one of said walls for access into the interior space and means to receive vertically stackable goods including two movable mutually opposed ledges in the upper portion, wherein said cart includes an insert having a height that is essentially equal to half the height of the cart, wherein the insert can be moved vertically in the interior space from the lower portion of said cart to the upper portion of said cart, wherein goods can be inserted into or removed from said insert through said opening, said cart having a spring means connected to power movement of the movable mutually opposing ledges, and each of the upright side walls of the cart in the upper portion is comprised of an elongated inner fixed part attached to each upright side wall and a movable part which is vertically movable and is between each upright side wall and said fixed part; each ledge is comprised of two mutually hinged, elongated rigid strips, an upper strip and a lower strip, said upper strip is hinged to the fixed part, said fixed part being provided with an aperture adjacent to each ledge, and that when said movable part is in a lower position, said upper strip will extend horizontally to support said goods-carrying trays, said upper strip and said lower strip will define an acute angle with one another, and wherein when the outer movable part is in an upper position and said upper strip and said lower strip extend generally vertically in said aperture said insert can move into the upper portion of the cart.

4. A catering cart according to claim 3, wherein said insert has a shoulder and respective said outer movable parts have an abutment surface that when said insert is lowered to a position beneath the lowermost of said horizontal ledges it engages with said shoulder for movement of said outer part vertically downwards against an upwardly acting force exerted by said spring.

* * * * *